United States Patent [19]

Poor

[11] 3,977,114

[45] Aug. 31, 1976

[54] RIFLE MAGAZINE

[76] Inventor: Robert G. Poor, 1013 Hawk Drive, Sacramento, Calif. 95833

[22] Filed: June 18, 1975

[21] Appl. No.: 587,852

[52] U.S. Cl. ..... 42/50
[51] Int. Cl.[2] ..... F41C 25/02
[58] Field of Search ..... 42/50, 18, 22

[56] References Cited

UNITED STATES PATENTS

| | | | |
|---|---|---|---|
| 2,427,304 | 9/1947 | Robbins | 42/50 |
| 2,441,735 | 5/1948 | Warner | 42/50 |
| 3,226,869 | 1/1966 | Musgrave | 42/50 |

*Primary Examiner*—Charles T. Jordan
*Attorney, Agent, or Firm*—Phillips, Moore, Weissenberger Lempio & Strabala

[57] ABSTRACT

A magazine for dispensing cartridges has improved capacity provided by an enlarged case and a hinged, two-piece follower pivotally mounted on a follower platform, which is elevated in the case by means of a spring. The enlarged case also serves as a hand rest to aid in steadying a rifle with which the magazine is used, thereby improving firing accuracy.

9 Claims, 8 Drawing Figures

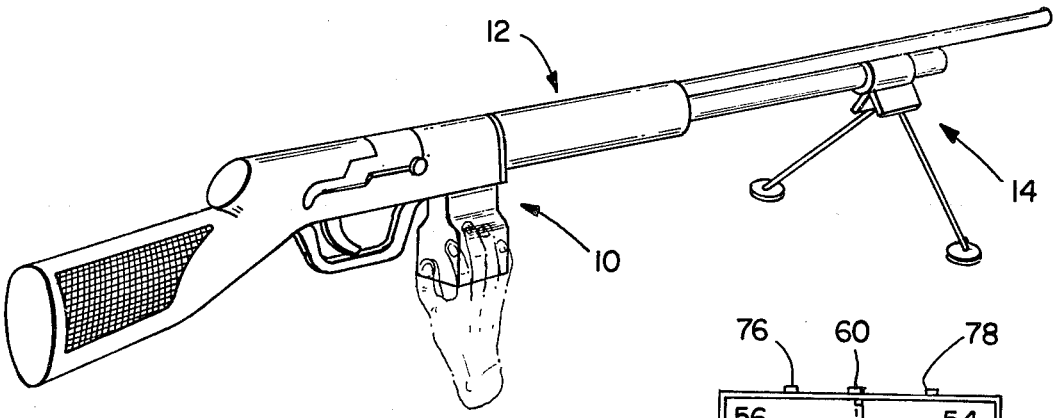
FIG _ 1
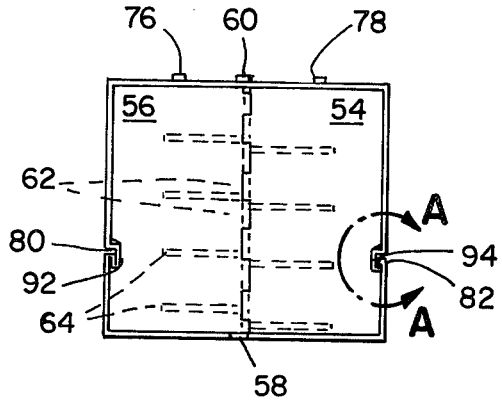
FIG _ 2A
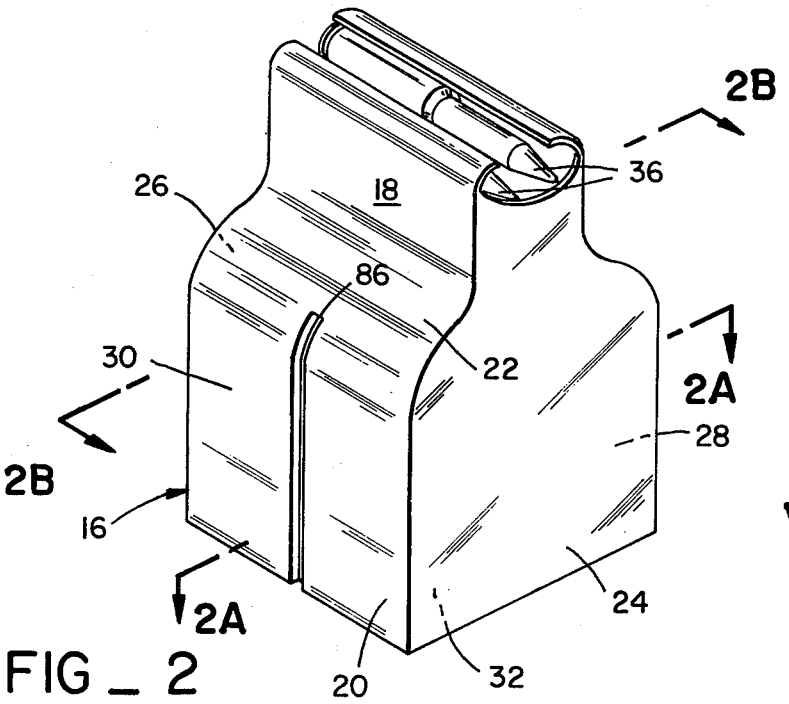
FIG _ 2
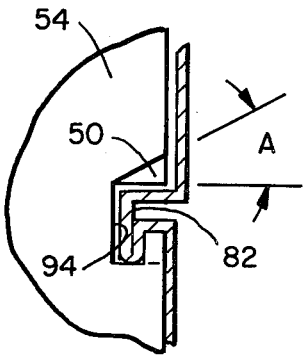
VIEW A-A

RIFLE MAGAZINE

BACKGROUND OF THE INVENTION

This invention relates to a rifle magazine and more particularly to a magazine having improved capacity for holding and dispensing cartridges.

While the following discussion talks in terms of a rifle magazine, it is to be understood that such is merely for the sake of convenience and that the application of the magazine is also contemplated for hand guns using cartridge magazines as well. Rifles, and especially automatic and semi-automatic rifles, typically use a cartridge magazine which is removably located to the rear of and just below the rifle chamber entrance. The cartridge magazines used with these semi-automatic rifles may have a capacity of five or six cartridges. Examples of patents showing rifles including cartridge magazines are: U.S. Pat. Nos. 439,833 and 462,298 to Bruce; 506,322 to Lee; and 3,039,221 to Musgrave. In some cases, cartridge magazines of greater length are used to increase capacity. These longer magazines or clips have been a response to the desirable purpose of providing greater capacity in order to enable the rifle to fire an even greater number of rounds before reloading. An example of this type of magazine is shown in U.S. Pat. No. 2,081,235 to Hillyard. With automatic rifles, of course, the number of rounds fired for a given unit of time can be quite large and a single long burst can easily empty a cartridge magazine of even fifteen-round capacity. A practical limit is soon reached when merely adding length to a cartridge magazine in an attempt to solve the capacity problem, since a very long length projecting downwardly tends to make the rifle unwieldy. Also, ground interference is encountered when the rifle is fired from a prone position. Other problems in the area of design are also encountered, since springs within the magazines are used to advance the cartridges by elevating a follower and very long springs cause loading difficulties.

For example, the cartridge spring force is typically proportional to the distance traveled. Thus, a maximum of force is generated when the magazine is fully loaded and the spring is fully compressed. As the cartridges are used up during firing, the spring advancing a cartridge follower extends and the force decreases. A minimum of force is generated when the last cartridge has left the magazine and the magazine spring and follower have reached their limit of travel.

Due to the rifle bolt's advancing of the chambering cartridge over the uppermost cartridge in the magazine, the bolt's motion is somewhat inhibited by the friction generated by sliding contact between the bolt and the uppermost cartridge. The variable force engendered by the magazine spring causes the bolt to chamber the cartridges at an increasing rate of speed as the cartridges are used up. The final round is chambered with a maximum speed. This action is disadvantageous in that the variable cyclic rate thus produced gives rise to burst fire inaccuracy when in full automatic operation.

SUMMARY AND OBJECTS OF THE INVENTION

The present invention attempts to solve these and other problems as above set forth by providing a cartridge magazine of greater capacity than many currently available, so shaped that it may also be used as a palm rest and a monopod eliminating the need for a conventional bipod found on semi-automatic and automatic rifles. Also, this invention eliminates the need for a cyclic rate reducer as used in the Russian Kalashikov AKM weapons system and at the same time acts as a cyclic rate stabilizer. Due to the fact that the magazine springs work in opposition to each other, this also causes the reuse of the space in the magazine body, making the magazine much more compact. The cartridge case of the instant invention is shaped so as to provide space for multiple columns of cartridges, necking down to the standard two columns at the point where the magazine case meets the accommodating receptacle in the rifle. A hinged, two-piece follower pivotally mounted on a follower platform in the case is advanced by means of a cartridge spring. The hinged, two-piece follower is spring biased by "rat trap" springs to fold the hinged follower halves over on itself prior to entering the two column portion of the case. Guide slots are provided in the case back wall for assisting in directing this folding action. In addition, rails mating with accommodating grooves in the follower also serve to guide and stabilize the elevation of the follower. The resultant cartridge magazine is considerably shorter than would otherwise be the case for the large number of cartridges contained therein.

It is therefore the primary object of this invention to provide a cartridge magazine of greater capacity which may be substituted for those presently used and which may be easily removed and replaced when empty so as to provide the capability of substantially continuous firing in firearms with which it is used.

It is a further object of this invention to provide such a magazine which doubles as a palm rest so as to facilitate stabilizing firearms with which it is used and thereby improve firing accuracy.

It is a further object to provide such a magazine that can be re-loaded in the field by conventional stripper clips.

Other and further objects of this invention will become more readily apparent by having reference to the following description and attached drawings.

BRIEF DESCRIPTION OF THE DRAWINGS

FIG. 1 is an overall view of a bipod mounted automatic rifle using the cartridge magazine of the instant invention illustrating its hand rest capabilities;

Figure 2B:
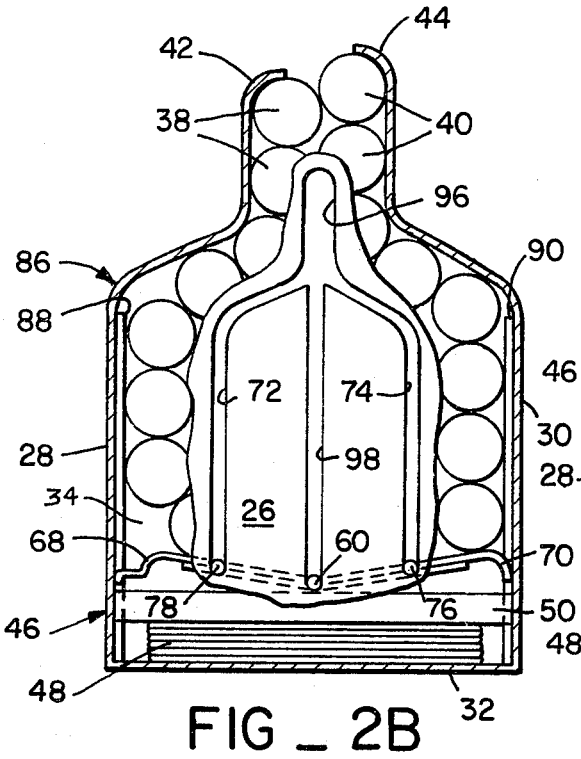
FIG. 2 is a top-quarter isometric view of a cartridge magazine of the instant invention illustrating constructional details thereof.
FIG. 2A is a cross-sectional view taken in the direction 2A—2A in FIG. 2 illustrating details of the follower mechanism.
Figure 3:
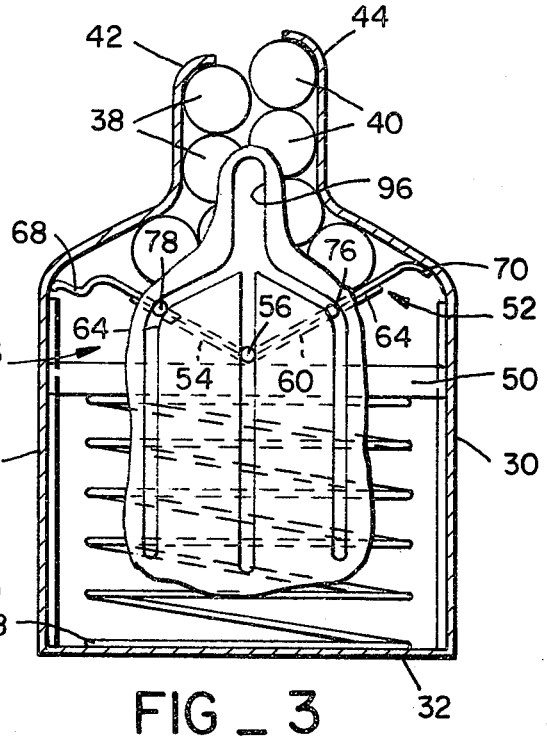
Figure 4:
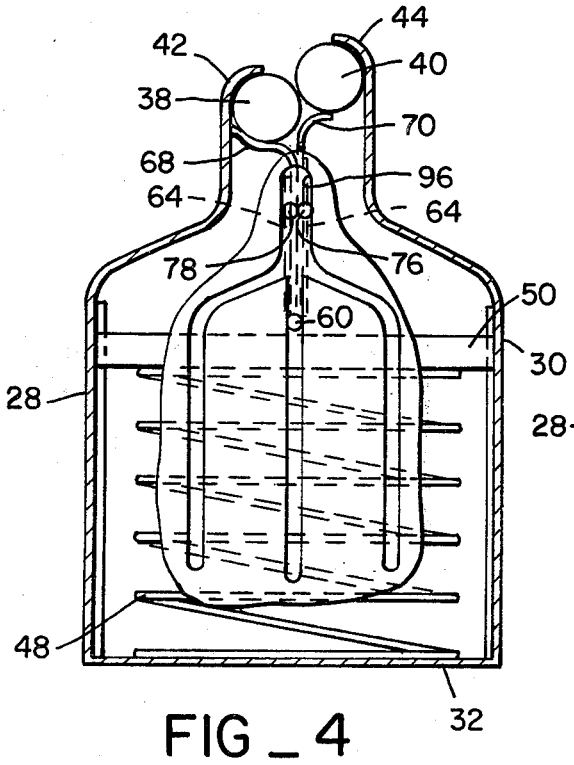
Figure 5:
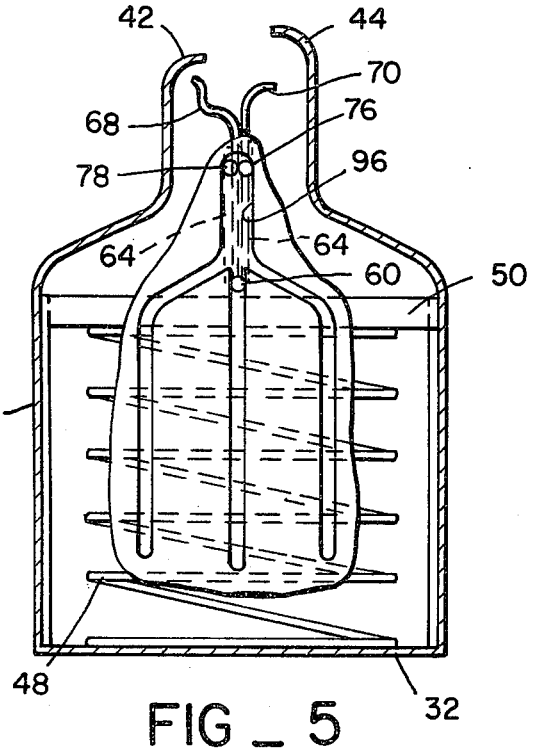

VIEW A—A is an enlarged view of the portion A—A in FIG. 2A;

FIG. 2B is a partly cut away view taken in the direction 2B—2B in FIG. 2 showing further details of the follower mechanism and the cartridge spring and the magazine fully loaded; and, FIGS. 3–5 show views similar to FIG. 2B showing in sequential form the emptying of the magazine and the action of the follower mechanism.

DETAILED DESCRIPTION

As seen in FIGS. 1 and 2 the cartridge magazine of the instant invention shown generally at 10 is designed to be used with a semi-automatic or automatic rifle 12. The rifle shown has a bipod support 14 attached to the barrel thereof.

The cartridge magazine comprises a thin-walled metal case or body 16 of generally elongated shape having a necked-down upper portion 18 and an enlarged lower portion 20 with a curved intermediate, transition portion 22. The body or case 16 is comprised of forward and rear walls 24,26, left and right side walls 28,30, respectively, and bottom wall 32. As best seen in FIG. 2, bottom wall 32 serves to close off the bottom of the case and thereby define an interior space 34 for containing a plurality of cartridges or rounds 36 in generally parallel, abutting relation.

In the top portion of the case 18, two columns of cartridges 38,40 are contained between the sidewalls. As best seen in FIG. 2B, a left lower arcuate step 42 about a half cartridge diameter below a right upper step 44 allows the two columns to intermesh so as to provide support thereto in the conventional manner. Below the upper case portion 18 the case smoothly transcends outwardly to provide space for a plurality of cartridges much wider than two columns. A generally rectangular metal follower assembly 46 supported by a magazine spring 48 intermediate the follower and the case bottom serves to provide the spring biasing force necessary to maintain the cartridges thereon and also to elevate the cartridges sequentially to the uppermost position wherein they are in a position to be chambered.

As best seen in FIGS. 2A and 3, the follower assembly consists of a box-shaped follower platform 50 which pivotally supports a hinged two-piece follower 52 defining follower halves 54,56. Hinged follower 52 is pivotally joined by a pin or pintle 58 having a button end 60 for a purpose to be hereinafter described. Knuckles 62 cooperate to retain the follower halves. A plurality of "rat trap" springs 64 serve to fold the hinged follower halves progressively closer together until they are in contacting relation as seen in FIGS. 3–5.

Arcuate steps 68,70 on the free edges of follower halves 54,56 opposite the hinged edges correspond to steps 42,44 to assist in ejecting the final cartridge from the upper case portion 18 as best seen in FIGS. 4 and 5. Magazine spring 48 is formed in a coil with one end in contact with the case bottom 32 and the other end in contact with the follower platform 50.

In operation, and as shown in FIGS. 2B and 3–5, removal of cartridges incident to firing allows the spring to elevate the cartridges initially with the follower halves 54,56 substantially parallel to follower platform 50. When the follower platform elevates to the beginning of the transition portion 22, the plate members begin to pivot towards each other (FIG. 3).

In order to assist in guiding and controlling the follower halves, a pair of arcuate channels 72,74 are included on the case back 26 which cooperate with a pair of button head projections 76,78 fixed intermediate the hinge and the free edges of each half. Also assisting are a pair of elongated, generally L-shaped rails 80,82 which are formed in the left and right side walls 28,30, respectively. As best seen in View A—A, these rails cooperate with channels in the follower half, one of which is shown at 94. The rear portion of the channel is relieved at an angle A in order to facilitate movement and to prevent jamming. The angle A may be conveniently set to be about 25°.

As seen in FIG. 3, rails 80,82 extend from the case bottom 32 to a point 86 where the side walls enter the transition portion. The rails are open at their topmost ends 88,90 so that the channels are permitted to leave the rails for subsequent vertical advancement of the follower halves 54,56 in the upper case portion 18. Channels 92,94 in the follower platform 50 are rectangularly shaped.

When the follower halves are fully pivoted into parallel relationship as shown in FIG. 4, button head projections 76,78 are further guided by a vertical channel 96 which is approximately twice as wide as the arcuate channels. A straight line extension 98 of channel 96 serves to guide button end 60.

FIGS. 4 and 5 show further progressive steps in emptying the cartridge. As shown, the cartridges 38,40 in the top portion of the case are staggered in conformance with the generally arcuate steps 68,70 on the free edges of the follower halves. Loading of the magazine is done by feeding cartridges from the top opening, either individually by hand or by using stripper clips.

It is to be understood that the foregoing description is merely illustrative of the preferred embodiment of the invention and that the scope of the invention is not to be limited thereto, but is to be determined by the scope of the appended claims.

What is claimed is:

1. In a generally rectangular, hollow cartridge magazine comprising a case having front and rear walls, a pair of side walls joined thereto and a bottom wall closing off the case and a top opening for discharging cartridges, a follower means in said case for supporting a plurality of cartridges, first spring biasing means in said case intermediate said follower and said case bottom wall for supporting and elevating said follower means, said follower means being of generally rectangular construction and defining a pair of generally rectangular plate members, said plate members being pivotally joined together over a contacting edge by a hinge.

2. The invention of claim 1 wherein said case has a narrow upper portion, an enlarged lower portion, and an intermediate transition portion.

3. The invention of claim 2 wherein said follower means comprise a generally rectangular follower platform and wherein said plate members are mounted on said platform along said contacting edges by means of said hinge, and further including a second spring biasing means for biasing said plate members into contacting relation.

4. The invention of claim 3 further including guide means on said case and follower means for guiding and controlling said follower means.

5. The invention of claim 4 wherein said guide means on said case include generally vertically oriented rails on said case and cooperating channels on said follower means.

6. The invention of claim 5 wherein said guide means further comprise a plurality of channels in said case and cooperating projection means on said follower means.

7. The invention of claim 3 wherein said first and second spring biasing means comprise first and second springs, respectively.

8. The invention of claim 1 wherein the edges of said plate members opposite to said contacting edge have generally arcuate steps thereon.

9. The invention of claim 1 wherein said hinge comprises a plurality of intermeshing knuckles and an elongated hinge pin.

* * * * *